US006415953B1

(12) United States Patent
O'Brien et al.

(10) Patent No.: US 6,415,953 B1
(45) Date of Patent: Jul. 9, 2002

(54) FIRST-IN FIRST-OUT VENDING MACHINE

(75) Inventors: David P. O'Brien, Savage; Allen E. Rogers, Owatonna, both of MN (US)

(73) Assignee: Vendtronics Inc, Plymouth, MN (US)

( * ) Notice: Subject to any disclaimer, the term of this patent is extended or adjusted under 35 U.S.C. 154(b) by 10 days.

(21) Appl. No.: 09/677,619

(22) Filed: Oct. 3, 2000

(51) Int. Cl.[7] ..... B65H 3/00
(52) U.S. Cl. ..... 221/196; 221/289
(58) Field of Search ..... 221/131, 129, 221/194, 196, 289, 296, 155, 67, 124; 211/59.2, 49; 312/45

(56) References Cited

U.S. PATENT DOCUMENTS

| | | | | |
|---|---|---|---|---|
| 1,773,329 A | | 8/1930 | Upham | |
| 2,663,604 A | | 12/1953 | Davies | |
| 2,711,241 A | | 6/1955 | Abrahamsen | |
| 2,977,023 A | | 3/1961 | Meyer | |
| 4,019,650 A | | 4/1977 | Oden | |
| 4,036,400 A | | 7/1977 | Oden | |
| 4,036,621 A | | 7/1977 | Burton | |
| 4,298,138 A | | 11/1981 | Oden | |
| 4,509,658 A | | 4/1985 | Oden | |
| 4,705,176 A | | 11/1987 | Oden | |
| 4,917,264 A | * | 4/1990 | Gosiel et al. | 221/289 |
| 5,176,287 A | | 1/1993 | Suris | |
| 5,392,953 A | * | 2/1995 | Maldanis et al. | 221/129 |
| D362,463 S | | 9/1995 | Vogelphol et al. | |
| 5,497,905 A | | 3/1996 | Vogelpohl et al. | |
| 5,505,332 A | | 4/1996 | Vogelpohl et al. | |
| 5,651,476 A | | 7/1997 | Percy et al. | |
| 5,927,539 A | | 7/1999 | Truitt et al. | |
| 5,967,364 A | | 10/1999 | Sawanson et al. | |
| 6,102,250 A | | 8/2000 | Leo, Sr. | |

* cited by examiner

*Primary Examiner*—Kenneth W. Noland
(74) *Attorney, Agent, or Firm*—James V. Harmon

(57) ABSTRACT

A vending machine has a housing or casing supporting one or more interior shelves or trays upon which beverage containers can be placed in a position to be viewed by a customer through a window in the front of the machine. The window is located in a door on the front of the machine that is used to stock the machine with fresh product from the front. Product containers are urged toward a vending channel at the rear of the machine and away from the stocking door, thus assuring a first-in first-out movement of each product container to assure freshness. The containers can be urged toward the vending channel by a spring, by gravity (as by placing them on an inclined tray surface and allowing them to slide toward the vending channel at the rear of the machine), or by means of a conveyor, e.g., a vibratory or belt conveyor. Each container in turn upon reaching the vending channel is released by a dispensing means into the vending channel through which it falls toward the product retrieval outlet at the front of the machine. An improved dispensing mechanism that acts positively to eject each container into the vending channel is also described.

14 Claims, 3 Drawing Sheets

16
22

72
70
42
26
26a
24
26
50
46a
26a
46
48
44
49
26
M
28
26a
52

A 1 2
B 3 4
C 5 6
D 7 8
E 9 10
54
57
55
48
46a
62
62
56
58
46
61
44
M
48a
60
49
64

FIRST-IN FIRST-OUT VENDING MACHINE

FIELD OF THE INVENTION

This invention relates to vending machines and more particularly to vending machines that are suited for vending beverages in bottles, cans or cartons.

BACKGROUND OF THE INVENTION

In any vending machine used to vend comestibles, especially beverages, it is important to be able to prevent product from remaining in the machine too long in order to assure that the product is fresh. If beverages, for example, are inadvertently placed where they will not be advanced toward the outlet ahead of freshly loaded containers, they could well remain in the machine beyond their designated shelf-life, causing customer complaints about the poor product quality. In the automated beverage vending machines now in use, the person stocking the machine with fresh cans or bottles must first remove old product temporarily, then insert the new product, and finally, reinsert the old product in order to make sure the old bottles or cans are dispensed first. This operation is labor intensive, time consuming, and permits old and new containers to become mixed or for other reasons to be dispensed in the wrong order.

In view of these and other deficiencies of the prior art, it is one object of the invention to reliably and automatically vend beverage products, such as bottled or canned beverages, on a first-in first-out basis without a service attendant having to temporarily remove and reposition the old product that remains in the machine.

Another object is to provide a first-in first-out vending machine that is reliable in automatically vending cans or bottles, is rugged in construction, and can be economically produced.

A further object is to provide a vending machine as described above with a reliable automated mechanism for dispensing a single beverage container when the customer makes a selection.

Yet another object is to enable the vended product to be removed from a single product retrieval door.

Still another object is to permit adjustments to be made to accommodate different size bottles and cans.

Yet another object is to enable customers to easily see the bottles and cans in the machine so that a selection can be made.

These and other more detailed and specific objects of the present invention will be better understood by reference to the following figures and detailed description which illustrate by way of example of but a few of the various forms of the invention within the scope of the appended claims.

SUMMARY OF THE INVENTION

The invention provides a vending machine having a housing or casing supporting one or more interior shelves or trays upon which beverage containers can be placed in a position to be viewed by a customer through a window in the front of the machine. The window is located in a door on the front of the machine that is used to stock the machine with fresh product from the front. The machine includes means for urging the product containers toward a vending channel at the rear of the machine and away from the stocking door, thus assuring a first-in first-out movement of each product container. The containers can be moved toward the vending channel in any suitable manner, e.g., by a coiled spring, by gravity (as by placing them on an inclined tray surface and allowing them to slide toward the vending channel at the rear of the machine), or by means of a conveyor, e.g., a vibratory or belt conveyor. Each container in turn upon reaching the vending channel is released by a dispensing means into the vending channel through which it falls toward the product retrieval outlet at the front of the machine. The following specification also describes an improved dispensing mechanism that acts positively to eject each container one at a time into the vending channel.

THE FIGURES

DETAILED DESCRIPTION OF THE INVENTION

Figure 2:
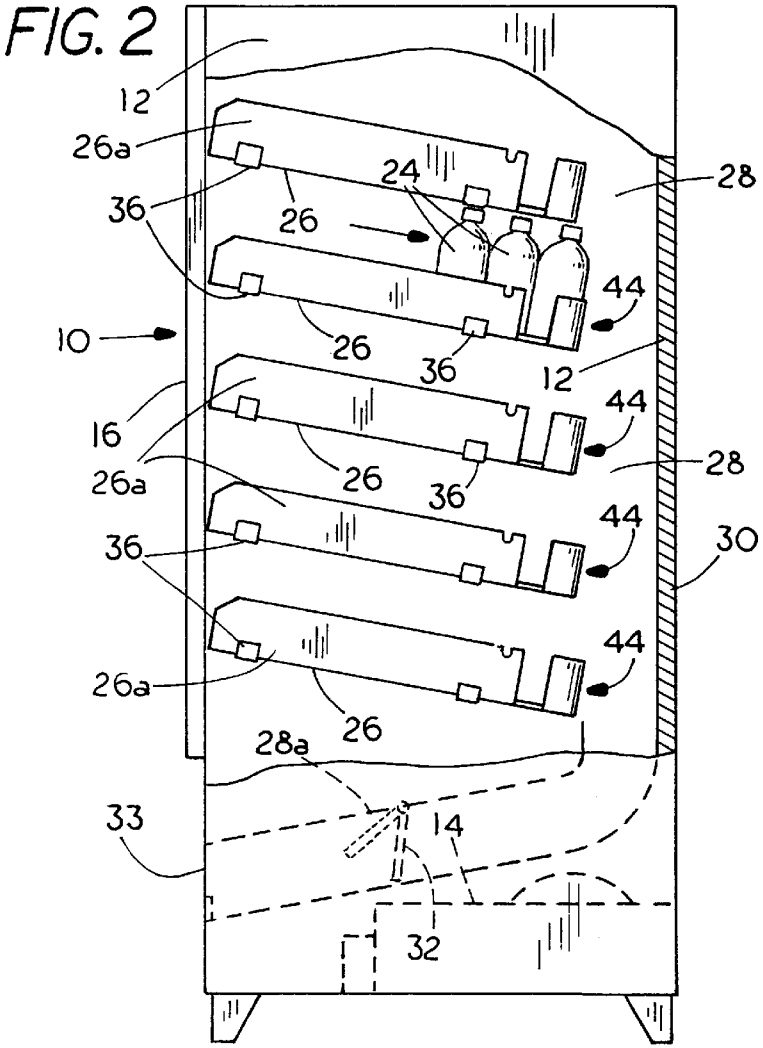
FIG. 2 is a right side elevational view of FIG. 1 on an enlarge scale partially in section.
Figure 1:
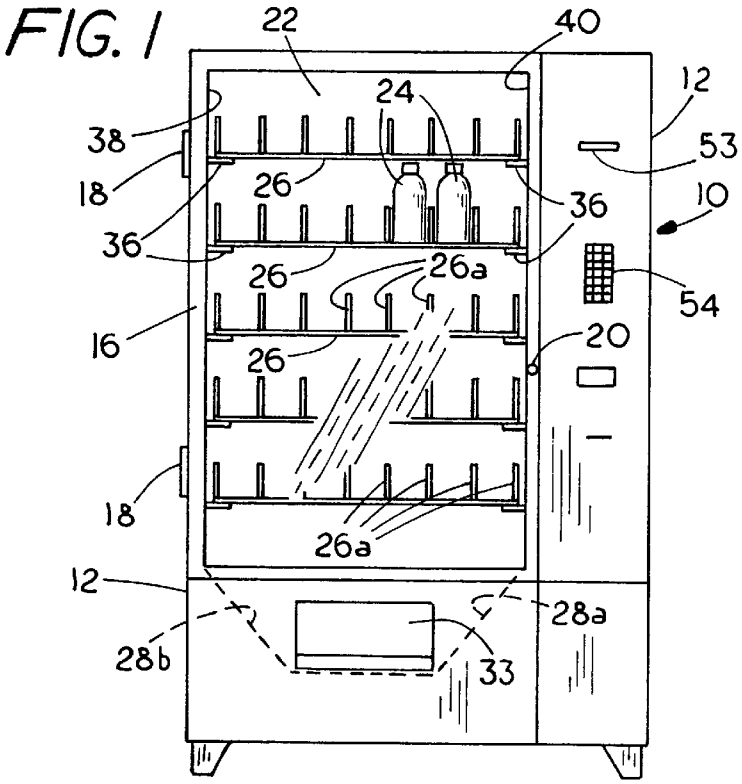
FIG. 1 is a front elevational view of the invention.

Refer now especially to FIGS. 1 and 2 which show a vending machine 10 having an insulated housing or casing 12 containing standard electrically powered refrigeration equipment 14 (FIG. 2), a front door 16 supported on hinges 18 and having a key-operated lock 20 and a large glass window 22 through which beverage containers 24 that are supported on one or more shelves or trays 26 can be easily seen by a customer who wishes to make a selection. Typically, four, five or six trays are used. A means is provided to urge the containers 24 toward a vertical vending channel 28 extending substantially entirely across the rear 30 of the machine 10 through which the containers fall as they travel toward a product door 32 to a product retrieval outlet 33 at the front of the machine. The lower portion 28*a* of the vending channel 28 is a chute that can be padded. The chute is inclined downwardly toward the front of the machine and has downwardly and centrally sloped side walls 28*b* and 28*c* (FIG. 1) to facilitate movement of the bottles 24 toward the door 32.

In this case the shelves are inclined downwardly at an angle of, say, 14° to the horizontal proceeding toward the vending channel 28 at the rear of the machine 10. This enables the containers 24 to slide rearwardly toward the outlet and away from the product stocking door 16 at the front of the machine 10. The trays 26 can be formed from a slippery material such as ultra-high molecular weight polyethylene or polytetrafluoroethylene and are provided with longitudinal grooves or striations 34 (FIG. 5) that extend toward the rear 30 to help the containers 24 slide rearwardly toward the vending channel 28. For clarity, the grooves 34 which extend the entire length of each tray 26 are shown only at the top of FIG. 5. Other means (not shown) can be provided to assist the containers 24 in moving rearwardly, such as one or more springs (a coil spring) or a conveyor, e.g., a vibratory, auger or belt conveyor. A sloped tray 26 is, however, preferred because it is low in cost and automatic in operation.

Figure 5:
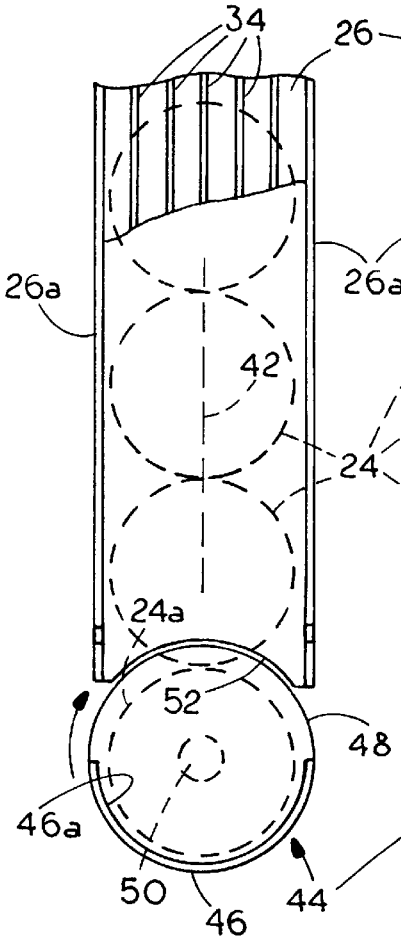
FIGS. 5–7 are sequential diagrammatic plan views showing successive stages of a single beverage container being dispensed from a row of containers supported on a tray within the machine.
Figure 6:
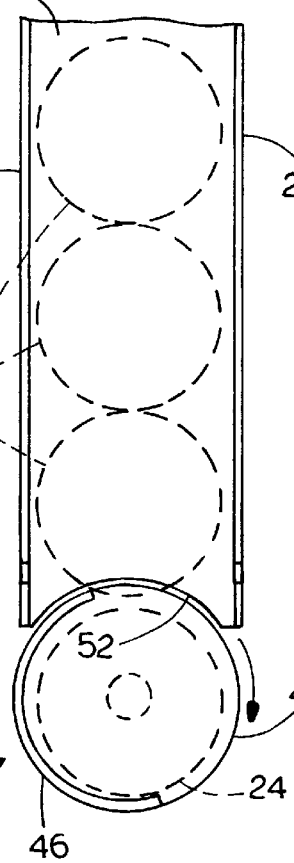
Figure 7:
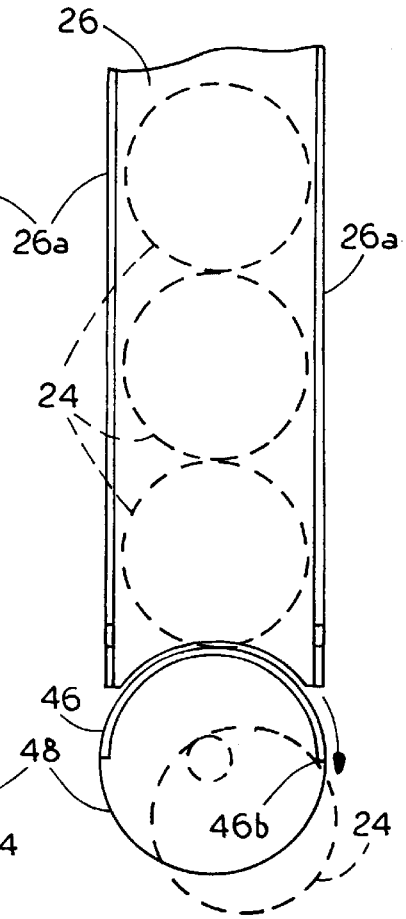

The trays 26 are supported on brackets 36, only a few of which are shown, connected to the inside walls 38, 40 of the machine 10, e.g., by fasteners such as screws. The brackets 36 can be moved up or down to selected positions on walls 38, 40 to change the spacing of the trays 26 for accommodating containers 24 of different sizes. Similarly, partitions 26*a* supported on trays 26 can be spaced at various distances from one another and reconnected by suitable fastening means to align the containers 24 in straight rows 42 each having an axis that is sloped downwardly proceeding from the front of the machine 10 to the rear 30 (FIGS. 3 and 5).

Figure 3:
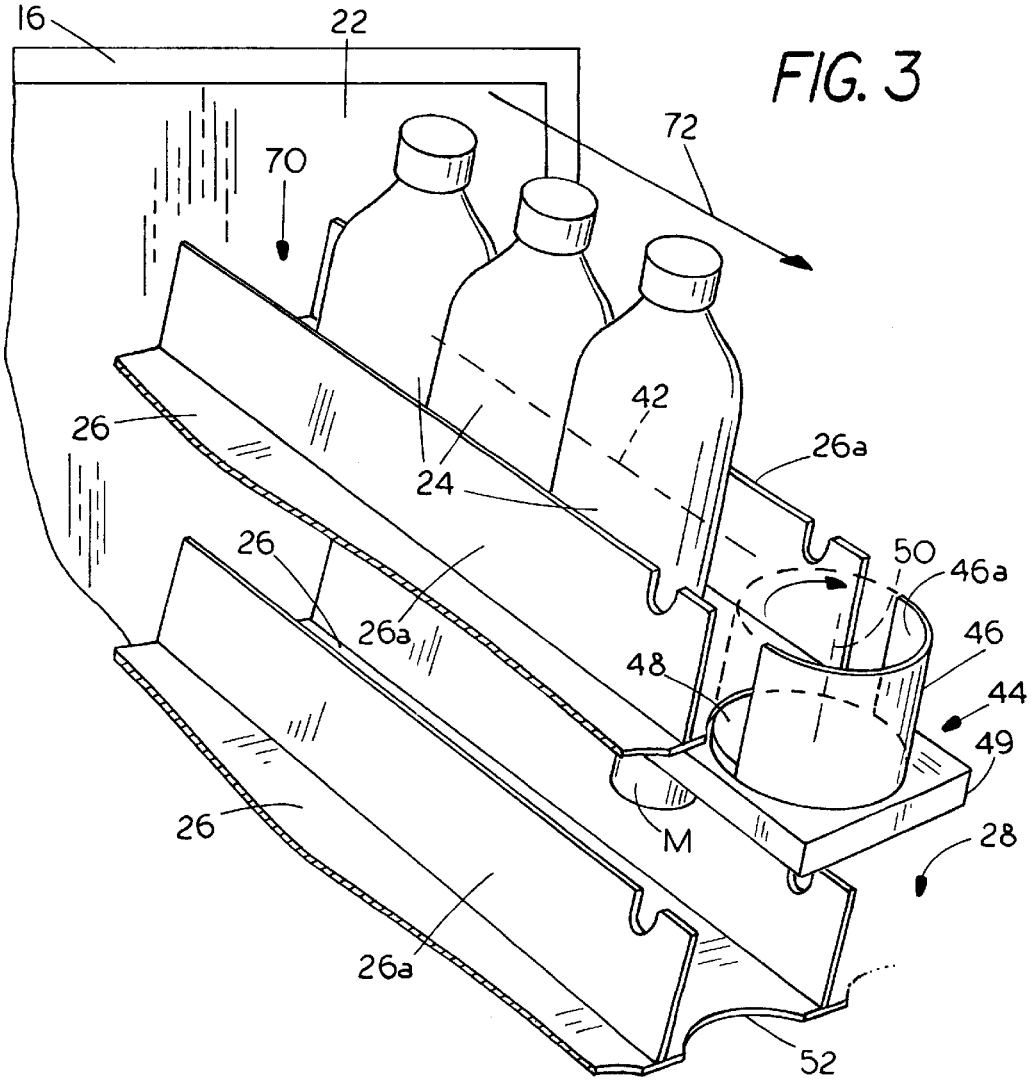
FIG. 3 is a perspective view of a row of bottles supported on an inclined tray within the machine where they can be viewed through a window in the front of the machine.
Figure 4:
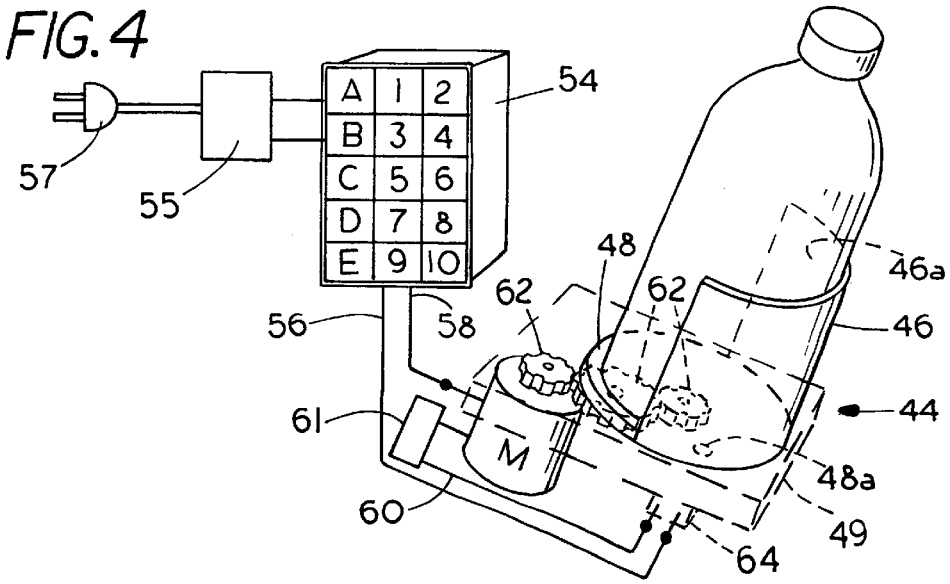
FIG. 4 is a combine schematic diagram and perspective view of the dispensing mechanism.

Refer now to FIGS. 3 and 4 with reference to a container dispenser mechanism indicated generally at 44 and provided at the rear end of each row 42 of containers. For clarity, only one dispenser is shown in FIGS. 3–7. The dispenser mechanism 44 at the end of each row 42 comprises a trough-shaped dispensing cup 46 that has a cylindrical interior surface 46*a* and is connected rigidly to a container supporting disc 48 aligned with tray 26 and journaled for rotation on a central axis 50 which is normal to the surface of the tray 26 within a gear box 49 affixed to the tray 26. The tray at the rear end of each row 42 is provided with an edge 52 (FIG. 3) that is cut out to a circular shape to match the disk 48 and is spaced from it by a small gap, e.g., one-eighth inch.

During operation, when the customer has made a selection, inserted the money in slot 53 (FIG. 1) and operated a selector switch 54 of suitable known construction that receives power from power supply 55 and wall plug 57, an electrical circuit is completed through conductors 56, 68 and 60 which are connected to an electric motor M that is supported on the gear box 49. This sends an electrical vend signal to the particular electric motor M that has been selected by switch 54, thereby turning the disc 48 and trough 46 via a gear train 62 through a single rotation, i.e., 360°, under the control of a microswitch 64 (FIG. 4) that is actuated by a projection 48*a* on disc 48. The microswitch 64 is connected through conductors 56, 58 and 60 to any suitable circuit means for providing a single rotation of the disc 48 and cup 46 such as a bistable switch means 61 known in the art for energizing the motor circuit responsive to a vend signal from selector switch 54 until de-energized. Examples include a thyristor, flip-flop, latching relay or the like. When the microswitch 64 detects a single rotation on disc 48, the motor M is de-energized with the trough 46 in the position shown in FIG. 5. The row 42 of containers 24 then slides rearwardly, loading the rear-most container 24*a* (FIG. 5) into the dispenser 44. As the supporting disc 48 and trough 46 rotate, the end-most container 24 is then free to fall under the influence of gravity into the vending channel 28. If, however, it become caught or otherwise fails to fall, the leading edge 46*b* of the trough 46 will strike and forcefully expel the container 24 (FIG. 7) from the tray 26 into the channel 28. The dispenser 44 is thus positive in its action and will reliably eject one container 24 at a time.

When the vending machine 10 is to be restocked with fresh beverages or other food containers, the service attendant places a key in lock 20, opens door 16 and, without having to remove or reposition any of the containers 24, places fresh product in the machine, say, at position 70 (FIG. 3). Thus, since the product moves from the stocking location 70 toward the vending channel 28 at the rear 30 in the direction shown by arrow 72, loading is simplified and yet the first product in is the first out, thus assuring freshness.

The machine 10 is suitable for any of a variety of foods or beverages, e.g., soda pop, water, alcoholic beverages and the like in either cans or bottles which are visible to the customer through the window 22. Dispensing is positive in action, and product is removed through a single product retrieval outlet 33.

Many variations of the present invention within the scope of the appended claims will be apparent to those skilled in the art once the principles described herein are understood.

What is claimed is:

1. A first-in first-out vending machine suited for vending beverage containers, comprising:

a housing having a front and a rear, a door at the front of the machine for stocking fresh product containers into the machine, a vending channel within the housing at the rear of the machine through which the containers are free to move toward a product retrieval outlet, at least one product tray extending between the door and the channel for supporting a least one row of the containers for movement proceeding from the door toward the vending channel at the rear of each row, means for urging the containers in each row toward the vending channel such that containers first loaded through the door are the first to enter the vending channel at the rear of the machine, and dispensing means for releasing a container at the rear of each row into the vending channel responsive to a vending signal.

2. The vending machine of claim 1 wherein the dispensing means comprises a trough-shaped cup connected to a product supporting disc that is mounted for rotation on an axis generally normal to the tray and located at the rear end of each row and means for rotating the disc and cup one revolution so as to dispense one container responsive to the vending signal from a product selector switch.

3. The machine of claim 1 including a plurality of said-trays positioned one above another and each tray having a plurality of upright partitions defining spaces for a plurality of said rows of containers, and the containers are beverage containers aligned in a plurality of said rows extending between the stocking door and the vending channel.

4. The machine of claim 1 wherein the means for urging the container toward the vending channel comprises a slope in said tray proceeding downwardly toward the rear of the machine for enabling the containers to slide rearwardly on the tray toward the vending channel.

5. The machine of claim 1 wherein the vending channel extends across substantially the entire rear part of a product compartment and the vending channel has a lower chute portion that is inclined downwardly proceeding toward a product retrieval outlet on the front of the machine.

6. The machine of claim 5 wherein the chute has sloped side walls that are inclined centrally proceeding downwardly from a top edge of each side wall.

7. The machine of claim 1 wherein the vending channel has a lower chute portion terminating in a single product retrieval outlet in the front of the machine and the chute has sloped side walls that are inclined centrally proceeding downwardly from a top part thereof for deflecting the containers toward the single product retrieval outlet.

8. A first-in first-out vending machine suited for food or beverage containers, comprising:

a housing having a front and a rear, a door at the front of the machine for stocking fresh product containers in the machine, a vending channel within the housing at the rear of the machine through which the containers are free to move toward a product retrieval outlet, at least one product tray extending between the door and the channel for supporting a least one row of the containers for movement proceeding from the door toward the vending channel at the rear of each row, means for urging the containers in each row toward the vending channel such that containers loaded first through the door are the first to enter the vending channel at the rear of the machine, dispensing means for releasing a container at the rear of each row into the vending channel responsive to a vending signal, said dispensing means comprising a cup connected to a product supporting member that is mounted for rotation at the rear end of each row and motive power means for rotating the member and cup so as to dispense a container responsive to a said vending signal.

9. A first-in first-out vending machine suited for food or beverage containers, comprising:

a housing having a front and a rear, a door at the front of the machine for stocking fresh product containers into the machine, a vending channel within the housing at the rear of the machine through which the containers are free to move toward a product retrieval outlet, a plurality of trays positioned one above another and each tray having a plurality of upright partitions defining spaces for a plurality of rows of containers, and the containers are beverage containers aligned in a plurality of said rows extending between the stocking door and the vending channel for movement proceeding from the door toward the vending channel at the rear of each row, means for urging the containers in each row toward the vending channel such that containers first loaded through the door are the first to enter the vending channel at the rear of the machine, a window in the front of the machine for viewing containers therewithin, and automatic dispensing means at the rear end of each row comprising a dispensing member mounted for rotation and a motor for rotating the dispensing member in response to a vend signal to thereby dispense a container from a rear end of a selected row into the vending channel at the rear of the machine.

10. A first-in first-out vending machine suited for food or beverage containers, comprising:

a housing having a front and a rear, a door at the front of the machine for stocking fresh product containers into the machine, a vending channel within the housing at the rear of the machine through which the containers are free to move toward a product retrieval outlet, at least one product tray extending between the door and the channel for supporting a least one row of the containers for movement proceeding from the door toward the vending channel at the rear of each row, means for urging the containers in each row toward the vending channel such that containers that are loaded first through the door are the first to enter the vending channel at the rear of the machine, dispensing means for releasing a container at the rear of each row into the vending channel responsive to a vending signal, the vending channel extends across substantially the entire rear part of a product compartment and the vending channel has a lower chute portion that is inclined downwardly proceeding toward a product retrieval outlet on the front of the machine, and the chute portion of the channel terminates in a single product retrieval outlet in the front of the machine.

11. The vending machine of claim 10 wherein the dispensing means comprises a cup connected to a product supporting disc that is mounted for rotation on an axis generally normal to the tray and located at the rear end of each row and means for rotating the disc and cup one revolution responsive to the vending signal to thereby dispense a container.

12. The machine of claim 10 wherein the chute has sloped side walls that are inclined centrally proceeding downwardly from a top edge thereof for deflecting the containers toward the single product retrieval outlet.

13. The vending machine of claim 11 wherein an electric motor is connected to the disc for rotating the disc, a bistable switch means is connected to the motor and to a product selector switch for rotating the disc and cup one revolution, and a switch is operatively connected to the motor for stopping rotation of the disc and cup after one revolution so as to dispense one container responsive to a vend signal from the product selector switch.

14. The machine of claim 13 wherein the machine contains a plurality of said trays, each tray has upright partitions thereon for receiving a plurality of rows of said containers therebetween, and the door includes a window constructed, sized and arranged to enable a customer to view a container at a front end of each row of containers.

* * * * *

UNITED STATES PATENT AND TRADEMARK OFFICE

CERTIFICATE OF CORRECTION

PATENT NO. : 6,415,953 B1 
DATED : July 9, 2002
INVENTOR(S) : Johan Arie Brambach It is certified that error appears in the above-identified patent and that said Letters Patent is hereby corrected as shown below:

Column 5,
Line 61, please correct from "marking" to -- making --.

Signed and Sealed this

Fifth Day of November, 2002

*Attest:*

*Attesting Officer*

JAMES E. ROGAN
*Director of the United States Patent and Trademark Office*